United States Patent [19]

Giger et al.

[11] 4,382,686

[45] May 10, 1983

[54] QUARTZ WATCH WITH ANALOGICAL TIME DISPLAY, COMPRISING A MANUALLY CONTROLLED TIME ALTERING DEVICE

[75] Inventors: Urs Giger, Solothurn; Norberto Perucchi, St. Blaise, both of Switzerland

[73] Assignee: ETA A.G. Ebauches Fabrik, Solothurn, Switzerland

[21] Appl. No.: 211,447

[22] Filed: Nov. 28, 1980

Related U.S. Application Data

[63] Continuation of Ser. No. 972,499, Dec. 22, 1978, abandoned.

[30] Foreign Application Priority Data

Dec. 31, 1977 [CH] Switzerland ..... 16377/77

[51] Int. Cl.[3] ..... J04 79/00

[52] U.S. Cl. ..... 368/187; 368/80

[58] Field of Search ..... 368/187, 188, 199, 76, 368/80, 189, 186, 69, 70

[56] References Cited

U.S. PATENT DOCUMENTS

| | | | |
|---|---|---|---|
| 3,841,081 | 10/1974 | Komaki | 368/189 |
| 3,948,036 | 4/1976 | Morokawa | 58/23 R |
| 3,962,861 | 6/1976 | Protta et al. | 58/4 A |
| 4,112,671 | 9/1978 | Kato et al. | 58/85 |
| 4,117,663 | 10/1978 | Mosimann et al. | 58/23 R |
| 4,185,453 | 1/1980 | Jaunin | 368/187 |
| 4,196,584 | 4/1980 | Oda | 368/187 |
| 4,199,932 | 4/1980 | Berney | 368/188 |

*Primary Examiner*—Bernard Roskoski

*Attorney, Agent, or Firm*—Parkhurst & Oliff

[57] ABSTRACT

In the quartz watch according to the invention all the time displaying hands (of the hours, the minutes and, possibly, the seconds) are kinematically permanently connected to each other, thus always displaying time in a very precise manner by their respective positions, whichever manipulations are made by the watch carrier.

The addition to the conventional parts of the watch of a detector sensitive to the manually controlled displacements of the hands and of a counting device for finishing off these displacements and for memorizing the time impulses during the manual correction, ensures automatically setting the hands in the exact time indicating positions thus permitting the watch carrier who travels from one time zone into another one to make rapidly the necessary time alterations without prejudice of the previous precision of the time indication.

8 Claims, 6 Drawing Figures

QUARTZ WATCH WITH ANALOGICAL TIME DISPLAY, COMPRISING A MANUALLY CONTROLLED TIME ALTERING DEVICE

This is a continuation of application Ser. No. 972,499 filed Dec. 22, 1978, now abandoned.

The invention relates to quartz watches with analogical time display, comprising a manually controlled time altering device. More particularly, the electronic unit of the watches contemplated here comprises an oscillator operating at an exactly adjusted frequency, a divider controlled by the oscillator and producing output impulses at a frequency which is a submultiple of that of the oscillator, a bidirectional motor having its coil connected to the output of the divider, and switch means interrupting the motor feed when they are actuated. Moreover, their mechanical unit comprises a gear train driven by the rotor of the motor and actuating the hands of the display device, a hand-setting mechanism, and a manually operable crown arranged for axial and rotary motions and actuating both the hand-setting mechanism and the switch means when it is set in a predetermined axial position.

With the known watches of this type, the hand-setting mechanism is similar to that of the conventional mechanical watches. The minute hand is carried by a snap-on cannon-pinion. If the watch also comprises a seconds-hand, manually setting the hands usually has only an effect on the hour hand and on the minute hand, so that the respective positions of the minute hand and the seconds-hand are generally not concordant. The difference thus occuring between the positions of those hands constitutes an awkward fault of so precise a timepiece as a quartz watch.

Some of the known watches of the type considered have already been arranged so as to permit easily altering the time either when the watch carrier travels from one time zone into another one or when he resides in a country with a particular summer time. For that purpose, the known watches comprise two hour wheels, one of them being driven by the pinion of the minute-wheel meshing with the cannon-pinion, and the other one carrying the hour hand and meshing with a correcting wheel connected to a manually operable control member. One of these two hour wheels is provided with a circular row of twelve apertures while the other one carries a dome-shaped projection entering one of said apertures. Normally, the two hour wheels are pressed against one another by a spring so that they rotate together. By means of a control member it is, however, possible to cause the hour wheel carrying the hour hand to rotate alone. Therefore, one of the two hour wheels must be movable in axial direction, thus permitting said dome-shaped projection to move firstly out of the aperture which it engages and then until it comes opposite another aperture of said row.

However, this independent displacement of the hour hand may raise further differences between the respective positions of the different hands.

Manually altering the time in the known quartz watches has still further drawbacks. Thus, when the correction is executed by means of the hand-setting crown, merely pulling this crown into hand-setting position interrupts every connection between the mechanical and the electronical units of the watch, and the last unit remains operative, however, without driving the hands. In other words, manually altering the time has in this case as a consequence the loss of the exact time display.

With the watches in which the hour wheel can be displaced alone, it happens sometime that the hour wheel driven by the correcting wheel exerts on the other hour wheel, upon unclutching therefrom, a stronger torque than that of the motor coil on the rotor. In other words, instead of letting the hour hand and its hour wheel rotate alone, the other hour wheel follows it a little while driving the whole time train and the rotor of the motor so that the watch does no longer display the exact time after the correction has been made.

The watch according to the invention avoids any imprecision of the time display. The hour wheel is ensured to lie always exactly opposite a horal division mark whenever the minute hand is on "60" and the latter will similarly always lie exactly opposite a division of the minute scale whenever the seconds-hand—if there is any—is on "60".

The watch according to the invention also permits—when travelling from one time zone into another one or when season time changes—to alter the time indicated by the watch while keeping the precision of the time displayed by the watch.

For these purposes, the watch according to the invention comprises:

a permanent kinematic connection between all the time indicating hands, a detector sensitive to each manual displacement of the hands and emitting impulses which, in number and sign, correspond to the amplitude and direction of every displacement of the hands, recording means receiving the impulses produced both by the divider, when the crown is in hand-setting position, and by the detector, thereby counting said impulses by congruence modulo an integer corresponding to a displacement of the hands equal to the smallest time altering provided for, said recording means rapidly transmitting to the motor all the impulses registered, when the hand-setting crown is pushed in its position of rest at the end of a correction.

The kinematic connection existing between the time displaying hands can be extended to all the rotary parts of the watch, which are driven by the motor, the rotor of the latter inclusive. Such an arrangement has the advantage of simplifying the mechanical unit of the watch.

To enable the usual setting of the hands without complicating the mechanical unit of the watch, its electronic unit will advantageously be provided with a decoder activated only if the total registered by the recording means, in absolute value, exceeds half the modulus of said recording means when the crown leaves the hand-setting position, the impulses registered by the recorder being transmitted to the motor only if the correction made has activated the decoder.

Two embodiments of the watch according to the invention are disclosed hereinafter together with some variants with reference to the accompanying drawings in which.

Figure 1:
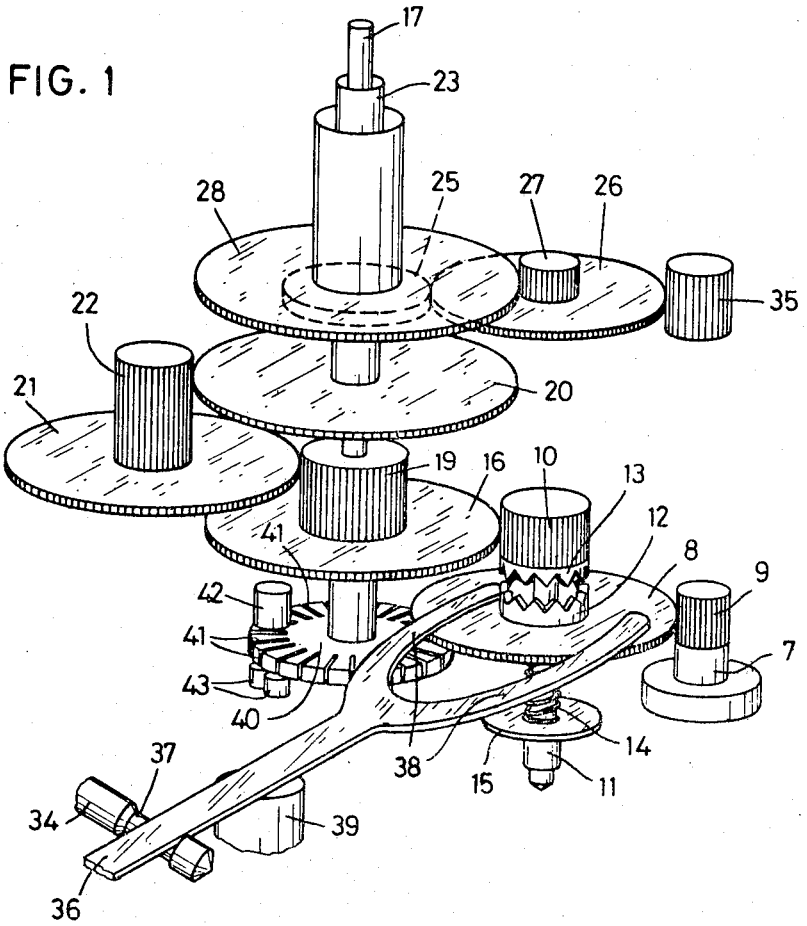
FIG. 1 is a perspective view of the movable parts forming the mechanical unit of the watch according to the first embodiment.

The electronic unit of the watch according to the first embodiment comprises a conventional oscillator 1, piloted by a quartz 2. They oscillate at a frequency which can be adjusted with great precision by means of a trimmer 3. The oscillator 1 is connected to a conventional divider 4 which progressively steps down to 1 Hz the relatively high frequency of the impulses emitted by the oscillator. As with the known quartz watches, the divider 4 thus normally emits one impulse every second into the circuit 5 including the coil 6 of a bidirectional motor which drives the mechanical unit of the watch, provided for displaying the time.

This mechanical unit substantially comprises a gear train driven stepwise every second by the rotor 7 of the motor. This train comprises a step-down gear comprising a wheel 8 meshing with the pinion 9 rigidly fixed to the shaft of the rotor 7, and a pinion 10 rigidly fixed to an arbor 11 on which the wheel 8 is mounted idly and so as to be able to move in axial direction. The wheel 8 and the pinion 10 each carries crown teeth 12, 13. These two toothings constitute a clutch. Normally, a spring 14, which bears on a disc 15 rigidly fixed to arbor 11, pushes wheel 8 against pinion 10 thereby holding the toothings 12, 13 in meshing relation with one another so that the step-down gear (8, 10) will move as a single piece. Pinion 10 itself meshes with a seconds-wheel 16 secured onto a shaft 17 carrying the seconds hand 18. A pinion 19 fixed to wheel 16 drives a great wheel 20 through a third wheel 21 meshing with pinion 19 and having a pinion 22 meshing with wheel 20. The latter is secured onto a hollow arbor 23 which is coaxial to shaft 17 and carries the minute hand 24. A toothed wheel 25, which carries out the task of the conventional cannon-pinions, is also secured to arbor 23. Wheel 25 meshes with the minute-wheel 26, the pinion 27 of which itself meshing with an hour wheel 28 carrying the hour hand 29.

It will appear from the above-standing description that there is a permanent kinematic connection between the three time displaying hands 18, 24 and 29. In other words, these three hands always and in each case move together. Since the gear train described is not compelled to transmit more force than necessary for overbalancing the bearing friction to its rotary parts, the toothings thereof can be designed with a very small free play, thus ensuring an exact time display. Accordingly, hand 29 will lie exactly opposite an horal division 30 of the dial 31 every time hand 24 will be on "60". Similarly, hand 24 will lie exactly opposite a mark 32 of the minute scale of dial 31 every time hand 18 will itself be opposite "60".

Figure 2:
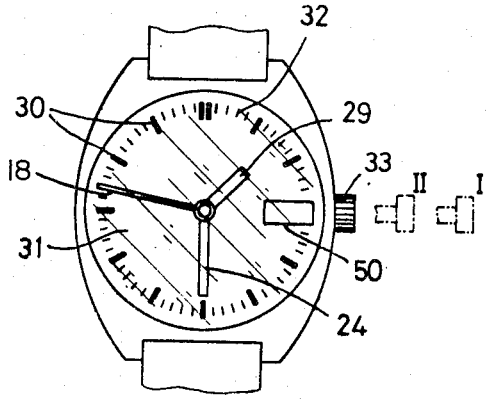
FIG. 2 is a plan view thereof.

A conventional hand-setting mechanism permits to displace the hands 18, 24, 29 manually by means of a crown 33 secured to a stem 34. By pulling crown 33 from its position of rest, represented in full lines in FIG. 2, into position I, represented in dot-and-dash lines in the same Figure, one establishes a kinematic connection as well known to those skilled in the art, between crown 33 and a setting pinion 35 which meshes with the minute-wheel 26. When crown 33 and stem 34 come in position I, an arm of lever 36 falls into a groove 37 of stem 34. Lever 36 has a forked end 38, which then moves wheel 8 in axial direction against the action of spring 14, until toothing 12 leaves toothing 13, as represented in FIG. 1. The motion work of the watch is then unclutched from rotor 7 of the motor. Upon bearing on wheel 8, fork 38 operates at the same time as a brake thus keeping the rotor immobile during all the time the crown 33 remains in position I. By falling into groove 37, the arm of lever 36 also closes a switch 39 thus initiating an action which will be disclosed hereinafter.

In order to maintain an operative connection between the mechanical and the electronic units of the watch when the motion work is unclutched from the motor, a disc 40 is rigidly associated with the seconds wheel 16, i.e. the gear carrying the quickest hand. This disc is provided with sixty slots 41 at its periphery. Slots 41 move opposite an optical probe tip comprising a light source 42 and two photosensitive diodes 43. One of the diodes 43 counts the number of slots 41 which pass in front of the light source 42 during a manual correction, and the other diode 43 detects the direction in which the manual correction causes the hands to move according as it will be enlightened before or after the first diode.

Figure 3:
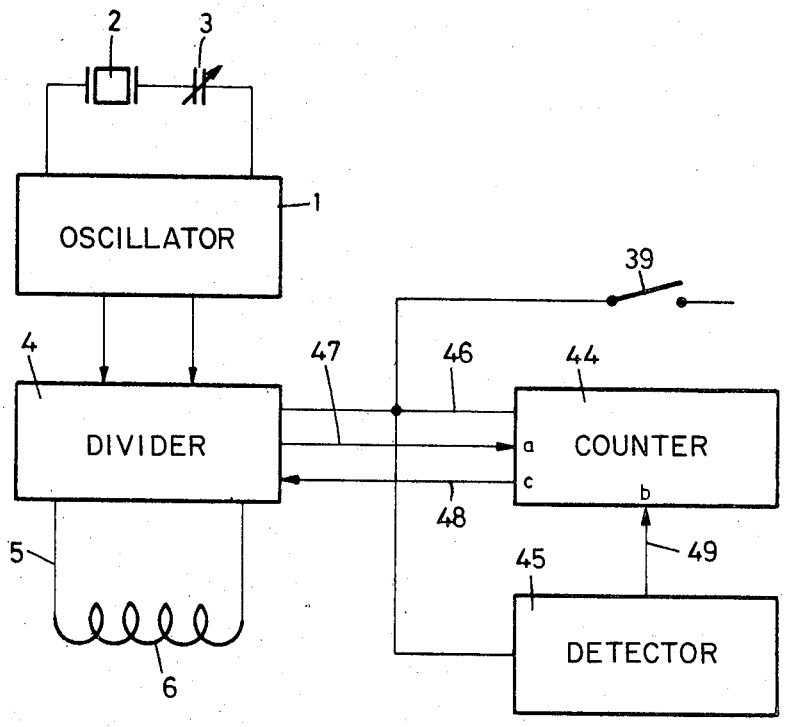
FIG. 3 is a wiring diagram of the corresponding electronic unit.

Besides the conventional parts already described the electronic unit of the watch represented in FIG. 3 still includes registering means comprising a counter 44 associated with the divider 4, and a detector 45 which includes the probe tip (42, 43) and transmits its readings to counter 44.

The two electronic parts 44, 45 are normally inoperative. However, closing switch 39, which occurs upon pulling crown 33 into position I as disclosed hereabove, activates these two electronic parts 44, 45. The closure of switch 39 affects the divider 4 and the counter 44 through line 46. On the divider 4 that action produces a deviation of the impulses which are normally fed by the divider directly to circuit 5, through a line 47, the counter 44 and a line 48. The activation of counter 44, which is produced upon closing switch 39, causes its inputs a and b to open, while its output c remains closed. As regards the activation of detector 45 by switch 39 which obviously produces the activation of the probe tip (42, 43) too, it ensures feeding input b of the counter 44 through line 49 with a number of impulses which is equal, in absolute value, to the number of slots 41 of disc 40 moving in front of the probe tip (42, 43).

Accordingly, when crown 33 is pulled into position I, it is mechanically connected to the motion work of the watch. That motion work is disconnected from the motor which is mechanically kept immobile. The motor coil 6 no longer receives any impulse from the divider 4 which feeds them to the counter 44 where they are memorized. Finally, the detector 45 and its probe tip (42, 43) are ready to operate. By rotating then crown 33, the hands 18, 24, 29 move all together, the probe tip (42, 43) counts the slots 41 of disc 40 passing in front of it and the detector 45 feeds an equal number of impulses through line 49 to the input b of counter 44. A signal produced by the second diode 43 of the detector 45 indicates to the counter 44 whether these impulses must be added to those received at input a or rather subtracted therefrom. The counter 44 thus establishes the algebraic sum of the impulses received at its inputs a and b.

It is the two elements 44, 45 of the electronic unit of the watch which, in combination with the arrangement disclosed of its mechanical unit, in particular the permanent kinematic connection provided between the time displaying hands, ensure the precision of the alterings of the time indicated through a whole number of hours.

Therefore, the counter 44 establishes the sum indicated by congruence modulo 3600, i.e. according to a modulus equal to the number of seconds in one hour or, in other words, the number in one hour of the unities of time indicated by the quickest hand.

If the time display were solely ensured by an hour hand and a minute hand and if the latter did move through one minute for example in three steps, the modulus according to which the counter associated with the divider 4 should operate would be equal to $60\times3=180$.

Adding the impulses received at a and b by congruence modulo a predetermined integer merely means that the counter will return to zero every time it has registered a number of impulses equal to that modulus, i.e. to 3600 in the embodiment represented in the drawing. If, for instance, the carrier of the watch wants to alter the time indicated by his watch through exactly three hours and if, for that purpose, he pulls the crown 33 into position I when the watch displays 2 h 23 m 41 s, and rotates afterwards the crown 33 until the watch displays 5 h 29 m 12 s, i.e. actually displaces the hands through 3 h 5 m 31 s, the detector 45 sends 11'131 impulses to the counter 44. The latter does, however, not register that number, but $11'131=3\times3600=331$, which corresponds to 5 m 31 s, i.e. a number corresponding to the imprecision of the manual correction.

In order to simplify the operation, the counter 44 comprises an inverter which changes the sign of the impulses registered every time the counter 44 has registered as many impulses as half its modulus, i.e. 1800 in the example described. Accordingly, upon moving the hands forwards by means of crown 33, the counter 44 successively records $-1$, $-2$, $-3$ and so on until $-1800$ during the first half hour. At that moment the sign of the impulses counted changes and when the hands are further moved in the same direction, the counter 44 successively records $+1799$, $+1798$, $+1797$, ... $+3$, $+2$, $+1$, 0, when the hands have been displaced through exactly one hour. If one moves the hands still further in the same direction, the counting cycle starts again from $-1$ to $-1800$ and then from $+1799$ to 0 during the second hour. If after having pulled the crown 33 into position I, the hands were, on the contrary, moved backwards, the impulses fed to input b of the counter 44 would then produce the successive records $+1$, $+2$, $+3$, ... $+1798$, $+1799$, $+1800$, $-1799$, $-1798$, ... $-2$, $-1$, 0, $+1$, $+2$ and so on.

In the correction example indicated hereabove, the impulses received at input b of counter 44 would be registered in the latter by the record $-331$.

At the end of the manual correction the crown 33 is pushed into its position of rest. That operation produces the opening of output c of counter 44. The normal direct way of the impulses (oscillator 1, divider 4, circuit 5) is however not yet open. It remains closed as long as the counter 44 is not empty, i.e. has not come back to zero. The divider 4 thus further feeds its impulses to the counter 44 through line 47.

Supposing in the correction example indicated hereabove that the correction lasted 17 seconds, i.e. that 17seconds have elapsed from the moment at which crown 33 was pulled into position I until it was pushed into its position of rest, the counter 44 would have received seventeen impulses at its input a. As disclosed hereabove, the counter registers the algebraic sum of the impulses received at the two inputs a and b. In the example considered it would thus register $+17-331=-314$ at the moment at which crown 33 would be pushed into its position of rest. The opening of output c of counter 44 which then occurs permits a number of impulses equal to the total recorded by the counter to pass quickly from the counter 44 into the circuit 5 of the motor.

In the example considered hereabove, the watch displayed 2 h 23 m 41 s when the crown 33 was pulled into position I for the purpose of moving the hands three hours forwards. In other words, the time which it should have displayed was 5 h 23 m 41 s. At the end of the correction, seventeen seconds later, when crown 33 is pushed into its position of rest, the exact time is 5 h 23 m 58 s. As supposed hereabove, the watch, however, displays 5 h 29 m 12 s. The counter, which recorded a total of $-314$ impulses, will thus immediately cause the hands to move backwards through 314 seconds=5 m 14 s, by injecting into circuit 5 of the motor 314 impulses having such a polarity that the motor will rotate backwards. After that injection, the watch will display 5 h 29 m 12 s−5 m 14 s=5 h 23 m 58 s, i.e. the exact time which has thus exactly been altered through three whole hours without prejudice to the precision of the time which the watch previously displayed.

In practice the counter 44 does not instantaneously inject into the motor circuit the impulses which it recorded during a manual correction. The rapidity of that injection depends on the abilities of the motor. The conventional motors are able to receive about thirty impulses in the second. In the example considered, the injection of the 314 impulses will thus last about ten seconds. The ten impulses emitted by the divider during that time will accordingly be led to the counter 44, which will add them algebraically to the former total so that it is not at 5 h 23 m 58 s, when crown 33 is pushed into its position of rest, but only about ten seconds later, that the watch will again display the exact time and that the impulses will again directly pass from the divider 4 into circuit 5 of the motor.

With the arrangement described, the crown 33 does not permit the usual setting of the watch if for any reason it does no longer indicate the exact time, as may occur for instance when it is stopped during the change of the battery.

A second working position II of crown 33 can, however, be foreseen to enable setting the date displayed in a window 50 of dial 31.

To enable setting the watch at the exact time, different means can be provided. The circuit of switch 39 could for instance be opened by means of a pusher which could be actuated when a reaction of the mechanical unit of the watch on its electronic unit is not desired during a correction of the position of the hands by means of crown 33. Means could also be provided for rendering switch 39 inoperative when crown 33 would be pulled into position I at a moment at which the seconds hand is for instance on "60". Alternatively, electronic means could be provided for supplying the motor with a train of quick impulses, when switch 39 is opened by pushing the crown into its position of rest, these impulses quickly moving the seconds hand on "60" and being then interrupted until the next time setting by a contact which the gear carrying the seconds hand would close when the seconds hand comes on "60".

The electronics specialist will be able without difficulty to conceive still further solutions as well as the circuitry of counter 44 and detector 45. A detailed description of the circuitry has therefore been disregarded.

The invention is not limited to watches that permit altering the time only through whole hours; it also concerns watches with which time alterings of a fraction of an hour are possible, for instance in view of the countries in which the official time is half an hour or a quarter of an hour set off with respect to the time of the 24 ideal time zones.

Figure 4:
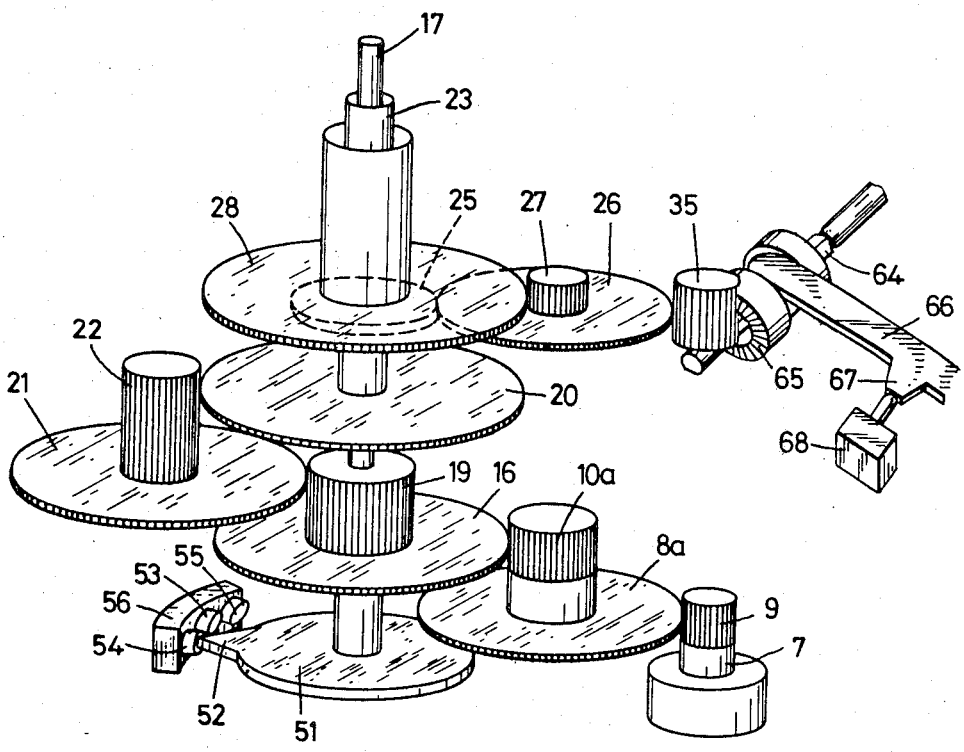
FIG. 4 is a view similar to FIG. 1 of the second embodiment.

The watch according to the second embodiment (FIGS. 4 and 5) permits altering the time through quarters of an hour. The parts of that watch which are identical to those of the first embodiment are designated by the same numerals and will not be disclosed in detail hereinafter.

Figure 5:
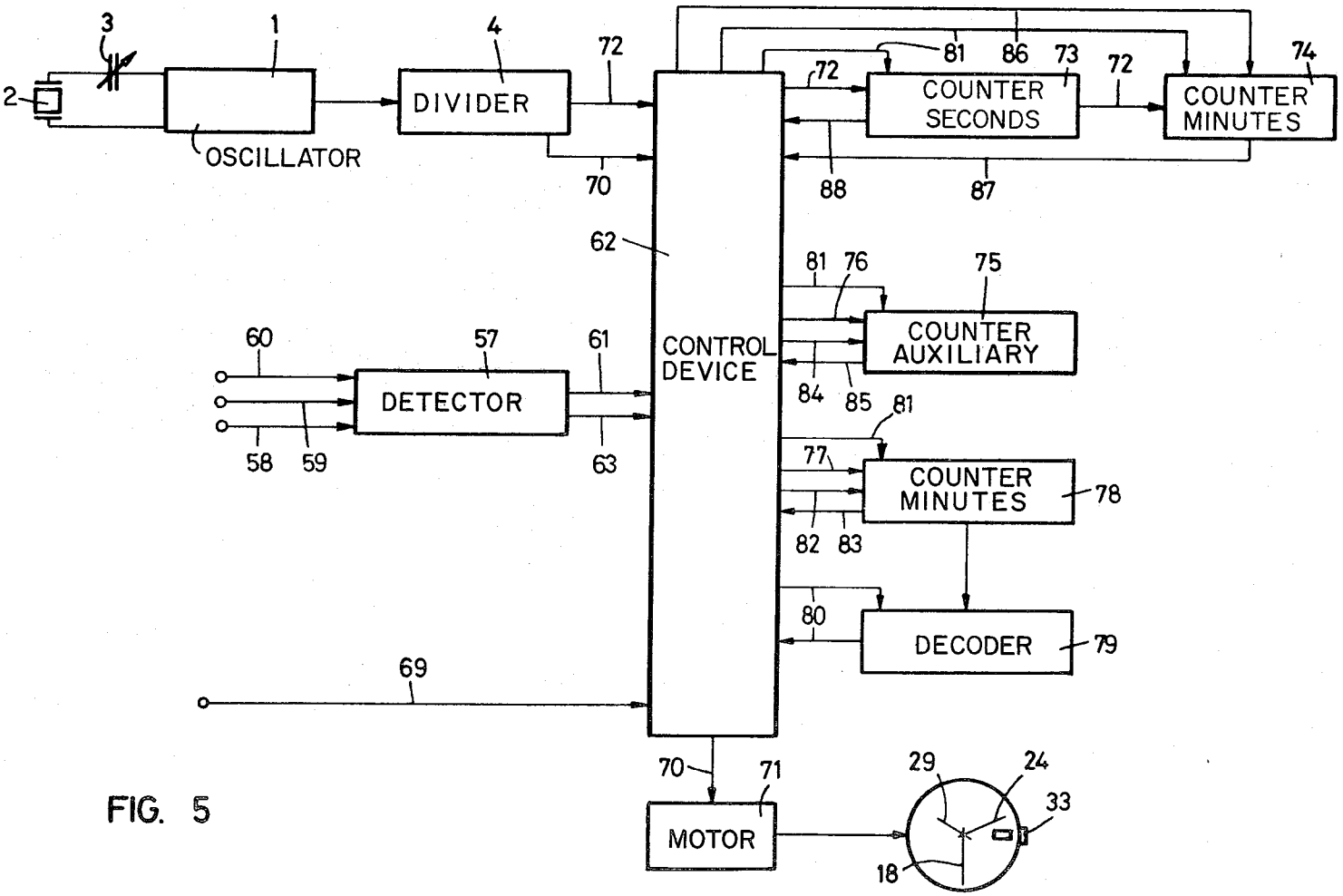
FIG. 5 is a wiring diagram of the corresponding electronic unit.

This second embodiment, which is the preferred one, differs from the first one in that its mechanical unit is simpler. Its step-down gear connecting pinion 9 of the rotor to the seconds wheel 16 merely comprises a wheel 8*a* rigidly fixed to a pinion 10*a*. Accordingly, the rotor 7 always rotates together with all the hands, when the latter are displaced manually. The braking action due to that connection has the advantage of rendering an accurate time correction by hand more easy. Moreover, the connection between the mechanical and the electronical units of the watch during a manual time correction is ensured by a disc 51 carrying a nose 52. When disc 51 rotates, its nose 52 successively actuates three contacts 53, 54, 55 of a probe tip 56 forming part of a detector 57 (FIG. 5). The contacts 53, 54, 55 close the circuits of lines 58, 59, 60, respectively. If contact 55 is closed after contact 53, the detector 57 emits an impulse in line 61, which indicates to the control device 62 that the hands rotate clockwise; whereas the closure of contact 54 after that of contact 53 produces the emission through line 63 to device 62 of an impulse indicating a counterclockwise movement of the hands.

The manual displacement of the hands is carried out by means of crown 33 (FIG. 5) through a stem 64 which urges a clutch wheel 65 into meshing relation with a setting pinion 35 by means of a yoke 66, as well known by those skilled in the art. Yoke 66 comprises a nose 67 which, in hand-setting position, actuates a contact 68 thus charging line 69 (FIG. 5) and energizing device 62.

That energization has different effects. At first, it interrupts line 70 which caused the impulses of divider 4 to pass directly to the motor 71. Then it opens line 72 through which the impulses of divider 4 reach a counter of the seconds 73 and, if necessary, a counter of the minutes 74. The counters 73, 74 operate as a memory. Moreover, the energization of device 62 initiates a train of quick impulses to the motor 71, which is interrupted only by the closure of contact 53. The latter is closed when hand 18 is on "60". Whichever the displacements of crown 33 may be, when it is in hand-setting position, the device 62 thus always causes the seconds hand to move afterwards quickly to the dial mark "60". Finally, the energization of device 62 still activates an auxiliary counter 75 also operating as a memory. Counter 75 records from line 76 the number of impulses which device 62 must supply to the motor 71 in order to move the seconds hand forward to "60" from the position in which it lies when crown 33 is pulled into hand-setting position. Counter 75 thus memorizes the position of the seconds hand 18 at the beginning of the manual correction.

The impulses which the control device 62 receives from detector 57, namely one at every complete revolution of the seconds hand, are transmitted through line 77 to a counter 78 where they are recorded by congruence modulo 15. As in the first embodiment, counter 78 is also provided with an inverter so that it will successively record $-1, -2, -3, \ldots -6, -7, +7, +6, \ldots +3, +2, +1, 0, -1, -2, -3$, and so on, or $+1, +2, \ldots +6, +7, -7, -6, \ldots -2, -1, 0, +1, +2$, and so on, when the hands are moved forwards and backwards, respectively.

The watch described finally comprises a binary decoder 79, which is normally in the state 0, but which passes in state 1, if the total of the recorded impulses in counter 78 at the end of a manual correction corresponds to a displacement of the hands clockwise or counterclockwise through more than $7\frac{1}{2}$ minutes.

When crown is pushed anew into its position of rest, at the end of the manual correction, the control device 62 starts with sounding decoder 79 through circuit 80. If the decoder is found in state 0, device 62 transmits orders through lines 81 to all the counters for putting them back to zero.

That means that the hands have been moved through less than $7\frac{1}{2}$ minutes. The watch owner did obviously not intend to alter the time indicated by his watch. The manual correction was carried out for resetting the watch at the exact time.

Since all the counters have been put to zero by device 62, the hands will normally be driven from the position in which they have been set, by the impulses of the divider 4 to motor 71 through line 70.

On the contrary, if decoder 79 is found in state 1, device 62 interprets the correction made as a time altering or a change of the time zone. It transmits then through line 82 the order to counter 78 to pass its total through line 83 to the motor 71. If this total is for instance $-6$, the counter 78 would transmit to motor 71 $6\times60=360$ impulses causing the same to rotate backwards through exactly six minutes.

As soon as device 62 will have ascertained that counter 78 is empty, it will give the order through line 84 to the auxiliary counter 75 to transmit its content to motor 71 through line 85. This will bring the seconds hand back to the position which it occupied before the correction.

Finally, after having ascertained that counter 75 is empty, device 62 gives to counters 73, 74, through line 86 the order to transmit their content after one another to motor 71 through lines 87 and 88. Since the impulses coming from the divider 4 follow line 72 as long as the counters 73, 74 are not at zero, the latter cause the display device to recover the resting time during the correction, or more exactly, during the time the crown 33 was in setting position.

As soon as the counters 73, 74 are empty, device 62 restores line 70 and the display device is again driven normally, however at the new time.

Supposing that the same correction as disclosed hereabove has to be made, it appears that when the watch owner pulls the crown 33 at 2 h 23 m 41 s to move the hands forwards through three hours, the control device 62 immediately sends nineteen impulses to the motor 71, thus causing the hands to display 2 h 24 m 00 s. Simultaneously, the auxiliary counter 75 passes from "0" to "19". As regards the impulses emitted by the divider 4, they are recorded by the counter 73 where they are memorized. Now, when the watch owner rotates the crown and displaces the hands on 5 h 29 m 12 s, the device 62 moves them further to 5 h 30 m 00 s. The 48 impulses transmitted to motor 71 while carrying out the last displacement are not recorded anywhere. Since the contact 53 has been closed 186 times during the displacements considered, the counter 78 has received 186 impulses. Counting them by congruence modulo 15, these 186 impulses move the counter, in absolute value, to $186-12\times15=6$. Due to the presence of the inverter in this counter, it is in fact the value "−6" that will be recorded. Finally, while supposing that the crown remains in setting position during seventeen seconds as in the example disclosed with reference to the first embodiment, it appears that the counter 73 will then be on "17" and the counter 74 on "0" when the crown will be pushed into its position of rest. The hands displacement carried out has moved decoder 79 to state "1".

As soon as one pushes the crown, the control device 62 firstly unlocks counter 78, which causes the hands to move backwards through 6 m. The hands then display 5 h 24 m 00 s. The auxiliary counter 75 is then in turn unlocked. It moves the motor 71 nineteen steps backwards, thus causing the hands to display 5 h 23 m 41 s. Finally, the control device 62 unlocks the counters 73, 74 which send seventeen impulses to motor 71 thereby moving the hands to 5 h 23 m 58 s as in the example disclosed hereabove with reference to the first embodiment.

If, at the time considered in this example (2 h 23 m 41 s), the watch owner decided to reset the date displayed by his watch, instead of altering the time, and if he pulled the crown by error into its handsetting position, he could only notice that error by rotating crown 33 and causing the hands to move. That erroneous operation would however not necessarily involve the loss of the exact time which his watch previously displayed. He needs only to move the hands farther until they indicate about either 2 h 10 m or 2 h 40 m and to push the crown into its position of rest. The effect of such a handling is that the watch will indicate a new time differing from the previous one by an amount of exactly 15 minutes. After that correction, the watch owner shall pull the crown again into its hand-setting position and displace the hands until they will display a time substantially comprised between 2 h 20 m and 2 h 25 m. By pushing the crown again into its position of rest, his watch will be reset at the original exact time in a full automatic manner.

Setting the watch at the exact time is easy with this second embodiment since the seconds hand automatically moves onto "60" as soon as crown 33 is pulled into hand-setting position. The watch owner thus needs only to observe the minute hand when he sets the time.

To facilitate setting the time when the battery has to be changed, the electronic unit of the watch can easily be arranged so that the decoder 79 remains in state "0" whatever the amplitude of the first hands displacement may be after a recharge of the circuits.

To prevent the counter 78 from recording one impulse too much, if the watch owner first causes the hands to move in the wrong direction for altering the time, it is advisable to locate the contacts 54 and 55 of the probe tip 56 in the immediate vicinity of contact 53, in order that the probe transmits an impulse to the control device and accordingly to counter 78 as soon as the hands are caused to move by hand. In that way, a first hands displacement in the wrong direction will always be compensated upon moving them in the right direction.

Figure 6:
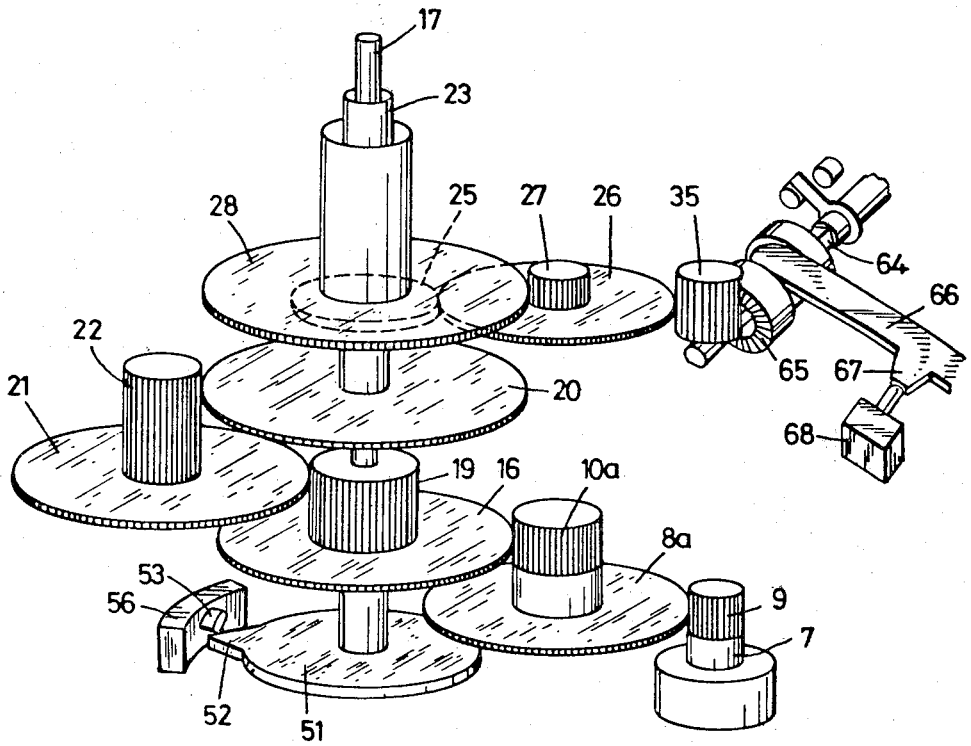
FIG. 6 shows a modification of the FIG. 4 embodiment.

For the same purpose, one could also in a modification of this second embodiment replace the contacts 54 and 55 of the probe tip 56 by two contacts located on each side of a finger frictionally set on stem 64, as shown in FIG. 6. Due to the free play of the gears of the motion work and of the hand-setting mechanism, these two contacts would produce recording the direction of the movement of crown 33 already before the hands start moving.

Instead of disc 51 with nose 52, one could also provide a circular disc having at its periphery segments which would be alternately conducting and insulating. In such a case, the probe tip would only need to comprise two frictional contacts. Its truth table would then be "11, 10, 00, 01, . . . " in one direction of rotation and "11, 01, 00, 10, . . . " in the other direction.

Finally, one could also resort to the voltage induced in the coil of motor 71 to detect the direction of the hands rotation during a manual correction. Although that voltage is about 50 V, it does not expose the electronic unit of the watch to any damage.

If the watch owner forgets the crown in handsetting position during a time period exceeding the counting capacity of counters 73 and 74, the exact time indicated by the watch will obviously be lost. To reset his watch at the exact time, he can in a first step set the hands in an approximate manner and push then the crown into its position of rest. Since the difference between the time which the watch displayed before that first correction and the time now displayed exceeds $7\frac{1}{2}$ minutes, the electronic unit of the watch will record that first correction as an altering of the time; it will thus produce some further displacement of the hands. This is immaterial, because the difference between the time then displayed and the exact time will be less than $7\frac{1}{2}$ minutes. The watch owner can then pull again the crown into its hand-setting position and, while awaiting the pips of the time signal, set the minute hand with precision.

We claim:

1. In an electronic watch with a manually operable displayed time altering device, a quartz oscillator providing a time signal, a frequency divider connected to said oscillator and providing a first string of pulses having a predetermined frequency and a predetermined sign, a bi-directional stepping motor normally rotatively driven by said first string of pulses in a sense corresponding to the sign of said first string of pulses, a gear train driven by said motor and a time display device comprising hands, the improvement wherein said hands are permanently coupled together through said gear train and said displayed time altering device comprises:

a control member displaceable from an inactive rest position to an active position, said control member being mechanically coupled to drive said gear train and associated hands when in said active position, switch means operatively associated with said control member and placed in a first operative condition when said control member is in said inactive position and in a second operative condition when said control member is in said active position, said switch means, when in said first operative condition, allowing said first string of pulses to be supplied to said motor and, when in said second operative condition, interrupting the supply of said first string of pulses to said motor; and, a recording means comprising a detector coupled to said gear train and providing a second string of pulses when said gear train is driven by said control member, the number and sign of said second string of pulses corresponding to the amount and sense of displacement of said hands, said detector being activated by said switch means being in said second operative condition, and counter means receiving said first string and pulses when said switch means is in said second operative position and having a predetermined counting capacity corresponding to the smallest time alteration to be effected, said counter means being activated by said switch means being in said second operative position to count said second string of pulses in accordance with the sign thereof and to algebraically add said first string of pulses from said divider to said counted second string of pulses, said counter means being responsive to said switch means moving from its second operative condition to its first operative condition to quickly feed a number of pulses to said motor corresponding to the sign and number of pulses resulting from said algebraic addition to thereby move said gear train and associated hands to a corrected time position.

2. The watch according to claim 1, wherein said algebraic addition results in a count value being stored in said counter means and said counter means supplies said number of pulses to said motor as it counts from said count value to a zero count reset state.

3. The watch according to claim 1, wherein said recording means further comprises a decoder which prevents a quick feeding of the motor with said number of pulses from said counter means if the hands are moved by said control member by an amount which corresponds to about less than half said counting capacity of the counter means.

4. The watch according to claim 1, wherein said counter means changes the sign of the pulses counted by the counter means each time the counter means reaches a count value corresponding to half its modulus.

5. The watch according to claim 1, wherein said permanent mechanical connection between the time displaying hands includes all the gears normally driven by said motor, the rotor of the latter inclusive.

6. The watch according to claim 1 further comprising clutch means located between a rotor of said motor and the quickest hand of said time display hands, means for unclutching said clutch when said control member moves to its active position, and braking means holding the rotor of said motor at rest at the same time as said clutch means are unclutched, and leaving said rotor free when said clutch means are clutched again.

7. The watch according to claim 10, wherein said detector comprises two contacts located on each side of a finger frictionally set on a stem of a hand-setting mechanism, for detecting the direction of rotation of said hands during a manual correction.

8. The watch according to claim 1, wherein the recording means further comprises memory means for recording the divider impulses.

* * * * *